US005186684A

United States Patent [19]

Weinberger

[11] Patent Number: 5,186,684

[45] Date of Patent: Feb. 16, 1993

[54] PORTABLE COMMUNICATION DEVICE

[76] Inventor: Morris J. Weinberger, 31 Rosewood Ct., Bowling Green, Ohio 43402

[21] Appl. No.: 807,137

[22] Filed: Dec. 13, 1991

[51] Int. Cl.[5] ..... B41L 1/20

[52] U.S. Cl. ..... 462/17; 281/44; 281/45

[58] Field of Search ..... 462/17, 22, 7; 281/44-49; 40/371

[56] References Cited

U.S. PATENT DOCUMENTS

| | | | |
|---|---|---|---|
| D. 248,106 | 6/1978 | Moses | D19/26 |
| D. 266,172 | 9/1982 | Fraser et al. | D19/26 |
| D. 267,152 | 12/1982 | Nerlinger, Jr. | D19/3 |
| D. 267,653 | 1/1983 | Miller | D19/26 |
| D. 302,698 | 8/1989 | Rexroat et al. | D19/26 |
| D. 311,548 | 10/1990 | Thompson, Jr. | D19/26 |
| 760,697 | 5/1904 | Morton | 462/17 |
| 939,149 | 11/1909 | Maxwell | 462/17 |
| 2,625,408 | 1/1953 | Hirsch | 462/17 |
| 3,314,464 | 4/1967 | Veilleux | 150/52 |
| 3,334,921 | 8/1967 | Fischer | 462/17 |
| 3,734,396 | 5/1973 | Cowan . | |
| 3,870,223 | 3/1975 | Wyant | 229/72 |
| 3,949,917 | 4/1976 | Mann | 224/290 |
| 3,999,317 | 12/1976 | Owens | 40/1.5 |
| 4,143,847 | 3/1979 | Cross | 248/459 |
| 4,186,868 | 2/1980 | Coleman | 229/92.1 |
| 4,566,721 | 1/1986 | Friedman et al. | 281/31 |
| 4,610,392 | 9/1986 | DaRosa | 229/1.5 R |
| 4,722,376 | 2/1988 | Rhyner | 150/147 |
| 4,968,065 | 11/1990 | O'Brien | 283/117 |

*Primary Examiner*—Timothy V. Eley
*Assistant Examiner*—Willmon Fridie, Jr.
*Attorney, Agent, or Firm*—David C. Purdue; John C. Purdue

[57] ABSTRACT

A portable communication device for providing a written record of communication is disclosed. The device comprises a case and a pad of carbonless, multiple sheet sets of message paper. The case comprises a rear panel having a major dimension and a minor dimension substantially perpendicular to the major dimension, a strike through shield connected to and depending from the rear panel, means for supporting a pad on said rear panel and, optionally, a cover including storage means for retaining sheets. The pad has a major dimension and a minor dimension corresponding with those of the rear panel, and the sheets include line means defining a writing area and extending generally in the direction of the minor dimension. The minor dimension is such that the device can be held in one's hand, between the heel and fingers, so that one's other hand can be used to write in the device. The major dimension should be at least as great as the minor dimension and preferably, it is approximately six inches.

5 Claims, 2 Drawing Sheets

PORTABLE COMMUNICATION DEVICE

FIELD OF THE INVENTION

The present invention relates generally to pad devices which can be utilized to make a written record of a verbal exchange and other communications between people.

DESCRIPTION OF PRIOR ART

There is an abundance of known products which can be utilized to provide a written record of communication between people. These include, generally, sheets and pads of paper, tablets, cards, carbon paper in sheets and in pads, sheets and pads of carbonless paper and the like. Also known are numerous folder type devices for holding and supporting paper and pads during use or storage.

A "Shirt Card" for recording information is disclosed in U.S. Pat. No. 4,968,065.

Examples of folder devices are disclosed in U.S. Pat. Nos. 3,314,464, 3,734,396, 4,143,847, 4,566,721, 4,610,392 and 4,722,376. Ornamental designs for folders are illustrated in U.S. Pat. Nos. Des. 248,106, Des 267,152, Des. 302,698 and Des. 311,548. Additional folder constructions are illustrated in U.S. Pat. Nos. 3,870,223, 3,949,917, 3,999,317 and 4,186,868 as well as U.S. Pat. Nos. Des. 267,653 and Des. 266,172.

A prior art carbonless check writing system is known and it comprises a pad of carbonless check blanks, a case which includes a back panel with a slot for receiving a portion of the pad of carbonless check blanks and a strike through shield which can be positioned between sets of carbonless check blanks to prevent writing on a first, upper set of check blanks from striking through to a second, lower set of check blanks. The strike through shield is connected to the back of the cover along a short edge thereof. Such a system is portable in that it can be transported in a shirt or pants pocket. The case has a rectangular shape and it has a minor dimension of three inches and a major dimension of six inches. The checks are printed with indicia including lines for recording certain information. The lines extend in a direction parallel to the major dimension and, as a consequence, it is next to impossible to hold the check book in one hand while writing on the line printed on the checks. In other words, in this prior art check book arrangement, one has to support the check book on a writing surface, i.e., a ledge or a table or the like.

Pads of carbonless paper are known and it is known that there is a need to utilize a strike through shield to prevent pressure exerted on a first set of carbonless sheets from activating the carbonless image chemicals in a lower set of carbonless sheets.

Despite the availability, generally, of paper pads and the like, there is a great deal of oral communication, particularly in business, that goes unrecorded. Many times, such communications concern matters which require follow up by one or both parties to the communications. Other times, such communications concern matters which will be relied upon by one or both parties at a later time. This is especially true in the context of employer/employee relations. In many cases, such communications go unrecorded and, consequently, follow up action, when indicated, is rarely taken. The sad result is a breakdown, to some degree, of communication channels between concerned parties. Such breakdowns in communication tend to spiral, further breaking down the channels of communication. In the work place, this can be catastrophic and can lead to serious consequences. The present invention meets this need for a device which can and will be used to record important communications in business. Other areas where the present invention can be used to address current needs is in the field of medicine and, particularly in respect of prescriptions which are, for the most part, issued without a record made by or for the doctors who issue them. Other applications for the device of the invention include change orders in the contracting business, and communications between government employees, but the applications are really limitless.

LIST OF OBJECTIVES

It is therefore a primary objective of the present invention to provide a device which can be used to produce multiple copies of a given communication.

It is another object of the present invention to provide a device which is portable and which can be easily held in one hand in a writing position.

Another objective of the present invention is to provide a device which will facilitate follow through on matters which are discussed between work mates.

Another objective of the present invention is to provide a device which can be easily used to record the substance of a discussion or other exchange between people and provide a written record thereof for both parties.

SUMMARY OF THE PREFERRED EMBODIMENT

Briefly, a preferred embodiment of the present invention includes a case and a pad of carbonless, multiple sheet sets of message paper. The case comprises a rear panel having a major dimension and a minor dimension substantially perpendicular to the major dimension, a strike through shield connected to and depending from the rear panel, means for supporting a pad on said rear panel and, optionally, a cover including storage means for retaining sheets. The pad has a major dimension and a minor dimension corresponding with those of the rear panel, and the sheets include line means defining a writing area and extending generally in the direction of the minor dimension. The minor dimension is such that the device can be held in one'hand, between the heel and fingers, so that one's other hand can be used to write in the device. The major dimension should be at least as great as the minor dimension and preferably, it is approximately six inches.

LIST OF ADVANTAGES OF THE INVENTION

An important advantage of the present invention is that it can be readily used by individuals who are standing or who are otherwise without a flat writing surface. It is another advantage of the present invention is that it is immediately accessible and begs to be used in situations where its use is indicated.

These and other objects and advantages of the present invention will no doubt become apparent to those skilled in the art after having read the following detailed description of the preferred embodiment which are contained in and illustrated by the various drawing figures.

DETAILED DESCRIPTION OF THE PREFERRED EMBODIMENT

Figure 1:
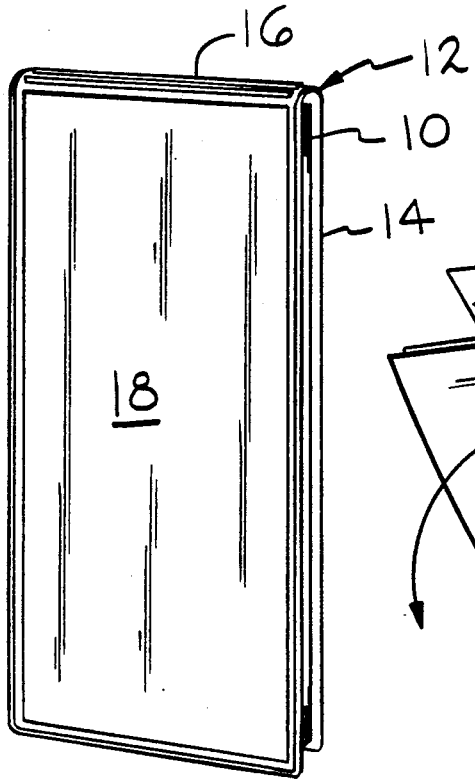
FIG. 1 is a perspective view of a communication device according to the present invention.

A communication device according to the present invention comprises a pad 10 and a pad case 12, as shown in FIG. 1. The device has numerous applications and is particularly suited for use in business where communication and records of such communication are extremely important. Other uses will become apparent from the detailed description of the device which follows.

The case 12 comprises a back panel 14 which, as described below in more detail, includes means for supporting the pad 10 as well as means for holding sheets that have been removed from the pad 10. The case 12 may optionally include a hinge 16 connected to the back panel 14 and connected to a cover 18. The case 12 can be formed integrally from heat formable/sealable plastic material. Reinforcing pieces of cardboard or the like (shown in FIG. 4) may be provided in the back panel 14 and, if desired, in the cover 18. In this type of construction, sheets of plastic material are positioned to cover the cardboard or the like and the edges of the plastic sheets are heat sealed to connect them, thereby capturing the cardboard or the like within edges of the plastic sheets. Although this construction is well known in the art and is considered to be very well known to the artisan, it is discussed in more detail below in connection with FIG. 4. Other forms of construction will occur to those skilled in this art their use is specifically contemplated within the scope of this invention.

The pad 10 comprises a plurality of rectangularly shaped sheets of paper, preferably joined adhesively along an edge to each other and to a cardboard backer, as is known in the art. The cardboard backer, as described below in more detail in connection with FIG. 4, below, is releasably retained in the back panel 14, whereby the pad 10 is supported in the case 12.

Figure 2:
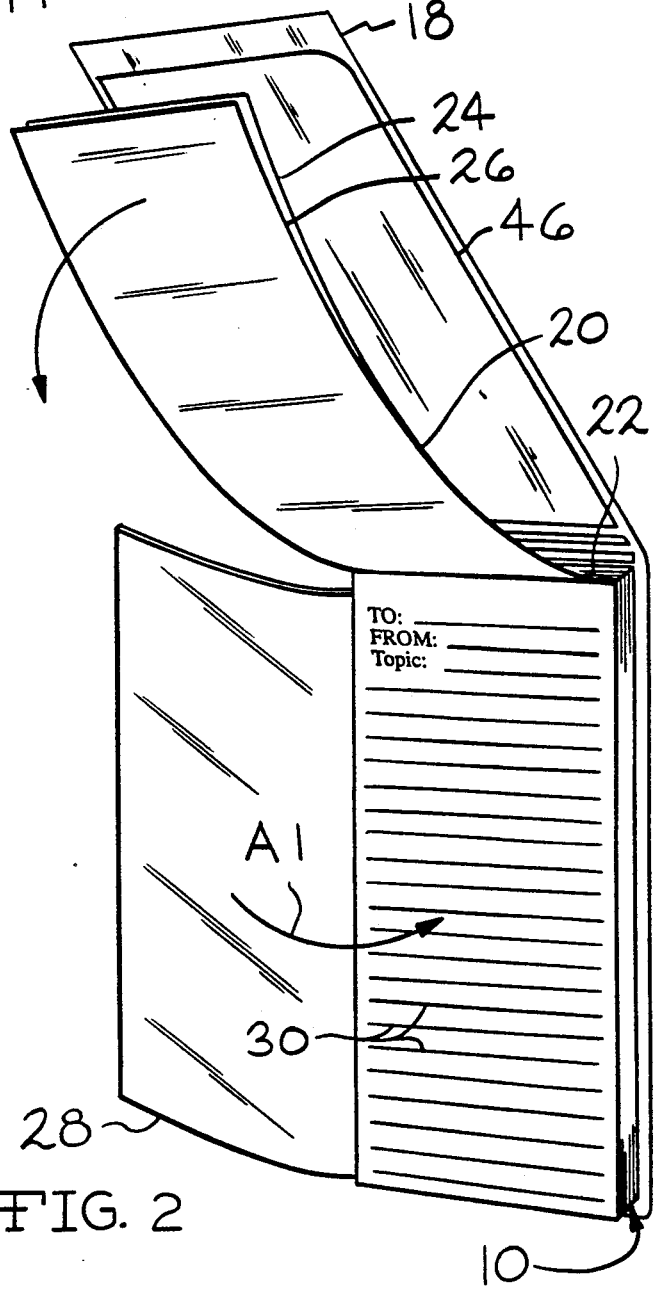
FIG. 2 is a perspective view of the device illustrated in FIG. 1 with the cover raised.

In FIG. 2, the device is illustrated after it has been opened by the lifting of the cover 18. The pad 10 preferably comprises a plurality of sets of sheets 20. It is preferred that each set comprise two or more sheets of what is known as carbonless paper, i.e., sheets which coact when pressure is exerted on the uppermost sheet to form an image on a lower sheet in the set. The sets of sheets 20 are preferably joined together along their common upper edges 22 in any suitable manner. Glue or, specifically, padding compound is a preferred means for connecting the sets of sheets 20 along their upper edges 22. Other means may be suitably employed. Each set of sheets 20 comprises a first, upper sheet 24 and a second, lower sheet 26. Additional lower sheets may be provided in each set 20, if desired. The set of sheets 20 themselves are well known. When one applies sufficient pressure to the first sheet 24, such as that pressure which is applied when one writes upon the first sheet 24, such as that by chemical reaction, on the second sheet 26.

A shield 28 is connected, as described below in connection with FIG. 4, to the case 12. The shield 28 is substantially the same size as the sheets 24 and 26 in the sets of sheets 20 in the pad 10. Preferably, the shield 28 is comprised of a semi-rigid plastic. The rigidity of the shield 28 is such that, when it is placed between adjacent, upper and lower sets 20 of carbonless paper sheets 24 and 26, it diffuses writing pressure exerted on the sheets constituting first, upper set 20 so as to substantially prevent coaction between the sheets constituting the second, lower set 20 of carbonless paper.

As indicated by an arrow A1 in FIG. 2, the shield 28 is manipulated to position it over the set 20 of sheets in which strike through is to be prevented. Thereafter, as indicate by an arrow, A2, a set of 20 of carbonless sheets at the top of the pad 10 is manipulated to position it over the shield 28. In this manner, the device is set to be used to record information. The shield 28 which is to prevent strike through is positioned between the uppermost set 20 of carbonless sheets in the pad 10 and the next uppermost set 20 of sheets of carbonless paper.

Figure 3:
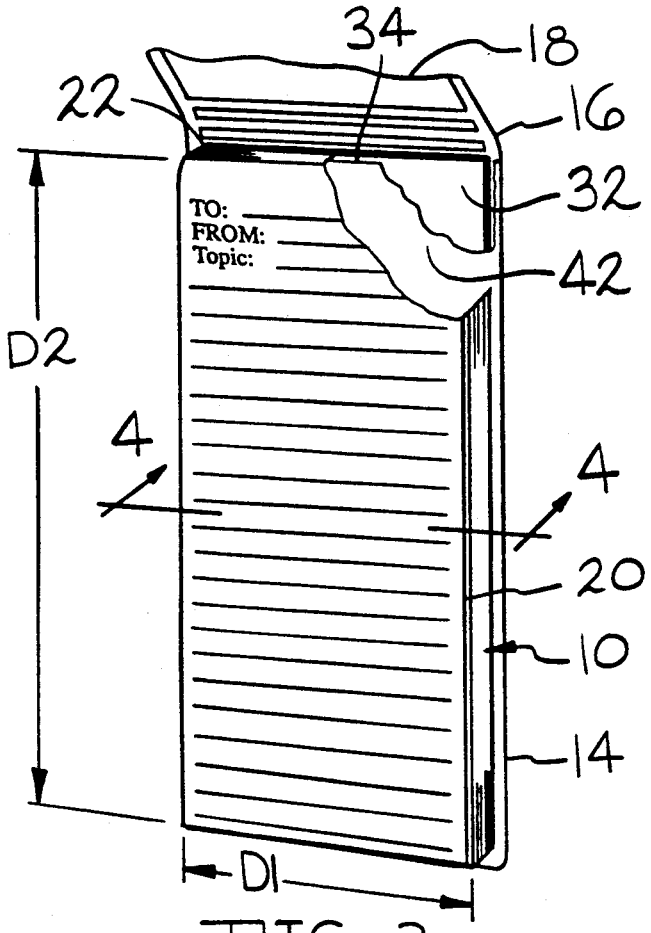
FIG. 3 is a perspective view of the device with a portion of the cover partially broken away.

Referring now to FIG. 3, it is to be noted that the sheets of paper which constitute the pad 10 are lined with rule means 30. In accordance with the present invention, the rule means define a writing area which extends from left to right in the direction of a minor dimension D1 of the pad 10. The minor dimension D1 is, preferably, about three inches but in no case is it longer than would permit the device to be held in one's hand, between the heel and fingers. Accordingly, the device can be held in a hand while one writes on the pad 10 in the device. pad 10 has a major dimension D2 which is at least as great as the minor dimension D1 and preferably, it is approximately six inches.

As indicated above, means are provided for supporting the pad 10 relative to the case 12. Preferred means are illustrated in FIG. 3. The pad 10 comprises sets 20 of sheets 24 and 26 which are secured along their common, upper edge 22, to each other and, preferably, to a cardboard backer 32. A slot indicated at 34 is provided in the back panel 14 to receive the cardboard backer 32, thereby supporting the pad 10 relative to the back panel 14. Other means for supporting the pad 10 relative to the case 12 will occur to those skilled in the art and, so long as they achieve the recited result, they are to be considered within the scope of the invention.

Figure 4:
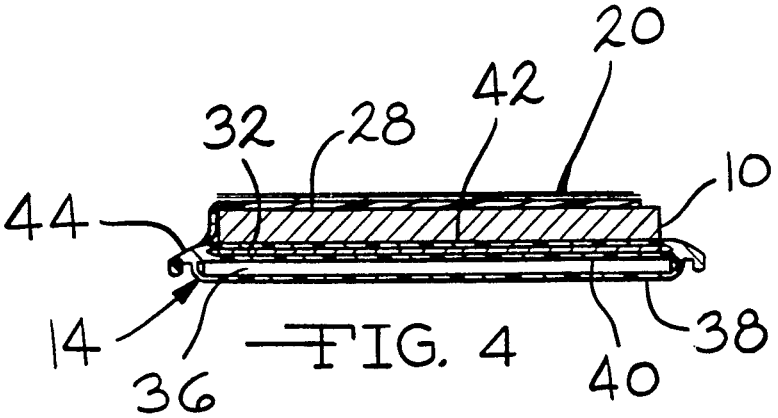
FIG. 4 is a sectional view of the device, taken along the line 4—4 of FIG. 3.

Details concerning the preferred construction of the device are shown in FIG. 4. The back panel 14 comprises a paperboard backer 36, first and second plastic sheets 38 and 40 enveloping the paperboard backer 36 and a third plastic sheet 42. The plastic sheets 38, 40 and 42 are heat sealed together around their peripheries, as indicated at 44. In the area where the shield 28 contacts the plastic sheets 38, 40 and 42, the shield is heat sealed to the plastic sheets 38, 40 and 42.

Once a communication has been reduced to writing on a set of 20 of carbonless sheets, it is expected that one of the sheets 24 or 26 carrying the communication would be provided to one of the parties to the communication while the other sheet would be retained by the person with the communication device. The latter sheet can conveniently be placed into a pocket formed beneath a flap 46 (FIG. 2) in the cover 18 for retrieval and indicated action, if any, at a later time.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A portable communication device comprising a rectangularly shaped pad having a major dimension and a minor dimension which is substantially half of said major dimension, said pad comprising a plurality of sets of carbonless sheets of paper connected to each other along a side which has the minor dimension, a case comprising a rectangularly shaped rear panel having substantially the same dimensions as said pad, said rear panel having a minor dimension and a major dimension, said minor dimension being such that the device can be held in an adult's hand, between the heel and fingers, a strike through shield having substantially the same dimensions as said rear panel, a side of said strike through shield having the major dimension being connected to a side of said rear panel which has the major dimension, rule means provided on said sets of carbonless paper, said rule means being oriented substantially parallel to said minor dimension, and means provided on said case for supporting said pad thereon.

2. The portable communication device claimed in claim 1 wherein said case further comprises a cover hingedly connected to the rear panel along a side thereof having the minor dimension.

3. The portable communication device claimed in claim 2 wherein said cover includes means for retaining sheets which have been separated from said pad.

4. The portable communication device claimed in claim 1 wherein the sheets of said pad have a minor dimension of three inches and a major dimension of six inches.

5. A portable communication device comprising a rectangularly shaped pad having a major dimension and a minor dimension which is substantially half of the major dimension, said pad comprising a plurality of sets of carbonless sheets of paper connected to each other along a side which has the minor dimension, a case comprising a rectangularly shaped rear panel having substantially the same dimensions as said pad, said rear panel having a minor dimension of three inches and a major dimension of six inches, said case further comprising a cover hingedly connected to said rear panel along a side thereof having the minor dimension, said cover including means for retaining sheets which have been separated from said pad, rule means provided on said sets of carbonless paper, said rule means being oriented substantially parallel to said minor dimension, a strike through shield having dimensions corresponding substantially with those of the sheets in said pad said strike through shield being connected to said rear panel along a side thereof which has the major dimension, and means provided on said case for supporting said pad thereon.

* * * * *